US005175904A

United States Patent [19]

Pagani

[11] Patent Number: 5,175,904

[45] Date of Patent: Jan. 5, 1993

[54] WRINGING DEVICE IN PARTICULAR FOR FRINGED STRIPS FOR CLEANING FLOORS

[75] Inventor: Elio Pagani, Arese, Italy

[73] Assignee: VDM S.r.l., Arese, Italy

[21] Appl. No.: 765,728

[22] Filed: Sep. 26, 1991

[30] Foreign Application Priority Data

Oct. 10, 1990 [IT] Italy ..... 21693 A/90

[51] Int. Cl.[5] ..... A47L 13/60

[52] U.S. Cl. ..... 15/262

[58] Field of Search ..... 15/262; 68/244, 248, 68/256

[56] References Cited

U.S. PATENT DOCUMENTS

| | | | |
|---|---|---|---|
| 1,517,187 | 12/1922 | Bonsall | 15/262 |
| 1,633,518 | 6/1927 | Clay | 15/262 |
| 1,922,981 | 8/1933 | Robertson | 15/262 |
| 2,535,244 | 12/1950 | Van Voorhis et al. | 15/261 |
| 3,504,393 | 4/1970 | Foss | 15/262 |
| 4,852,207 | 8/1989 | Yamane | 15/262 |

FOREIGN PATENT DOCUMENTS

| | | |
|---|---|---|
| 583653 | 8/1933 | Fed. Rep. of Germany . |
| 177911 | 6/1935 | Switzerland . |

*Primary Examiner*—Edward L. Roberts
*Attorney, Agent, or Firm*—Guido Modiano; Albert Josif

[57] ABSTRACT

The wringing device in particular for fringed strips for cleaning floors, comprises a frame which oscillatably supports about a main axis, a supporting element for a roller. The roller can rotate with respect to the supporting element about its own axis which is arranged parallel to the main axis. The frame is provided with a wall which faces the roller and is shaped like a portion of a cylindrical surface having an axis which substantially coincides with the main axis. An actuator acts on the supporting element to oscillate it about the main axis, with consequent sliding of the roller along the wall to wring a fringed strip interposed between the roller and the wall.

6 Claims, 2 Drawing Sheets

WRINGING DEVICE IN PARTICULAR FOR FRINGED STRIPS FOR CLEANING FLOORS

BACKGROUND OF THE INVENTION

The present invention relates to a wringing device in particular for fringed strips for cleaning floors.

Devices for wringing fringed strips used to clean floors are known. Among them, a device is known which is substantially constituted by two rollers with mutually parallel axes which face one another. The fringed strip is inserted between said two rollers, which are moved closer to one another, and one of the rollers is actuated with a rotary motion about its own axis, while the other roller can rotate freely so that the strip is pulled so as to pass between the rollers, thus wringing it.

This type of device has the disadvantage that it requires the disassembly of the strip to be wrung from the implement which supports it. Furthermore, due to its structure, the use of particular trays for collecting the liquid produced by the wringing is required.

Devices are also known which can perform wringing without requiring the disassembly of the strip to be wrung.

One of the devices of this type is constituted by two rollers which have mutually parallel axes, a first roller being freely rotatable about its axis, the second roller being instead oscillatable about an external axis, which is parallel to the roller axis, so that it can be moved closer or away from the free roller, and can be actuated with a rotary motion.

The movement of the second roller and its rotation are obtained by means of a single lever which, by means of a gear transmission system, causes oscillation of the second roller about the external axis and its rotation. The fringed strip is inserted between the two rollers and is wrung by means of the rotation of the second roller, which induces a rotation of the first roller in the opposite direction.

This type of device, although it achieves an excellent wringing, has the disadvantage of being mechanically complicated, which leads consequently to high manufacturing costs.

SUMMARY OF THE INVENTION

The aim of the present invention is to provide a wringing device in particular for fringed strips for cleaning floors which is structurally simple and which thus can be manufactured with reduced costs although it nonetheless ensures satisfactory results comparable with those obtainable with more complicated and expensive known devices.

Within the scope of this aim, an object of the invention is to provide a device which, by virtue of its structural simplicity, is highly reliable in operation and has great durability without requiring maintenance interventions.

Another object of the invention is to provide a device which is easy to use even for non-expert personnel.

This aim, these objects and others which will become apparent hereinafter are achieved by a wringing device in particular for fringed strips for cleaning floors, characterized in that it comprises a frame which oscillatably supports, about a main axis, a supporting element for a roller which is freely mounted on said supporting element and is arranged so that its axis is parallel to said main axis, said frame having a wall which faces said roller and is shaped like a portion of a cylindrical surface which has an axis which substantially coincides with said main axis, actuation means being furthermore provided which act on said supporting element for its oscillation about said main axis, with the consequent sliding of said roller along said wall to wring a fringed strip interposed between said roller and said wall.

BRIEF DESCRIPTION OF THE DRAWINGS

Further characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figures 1, 2, 6:
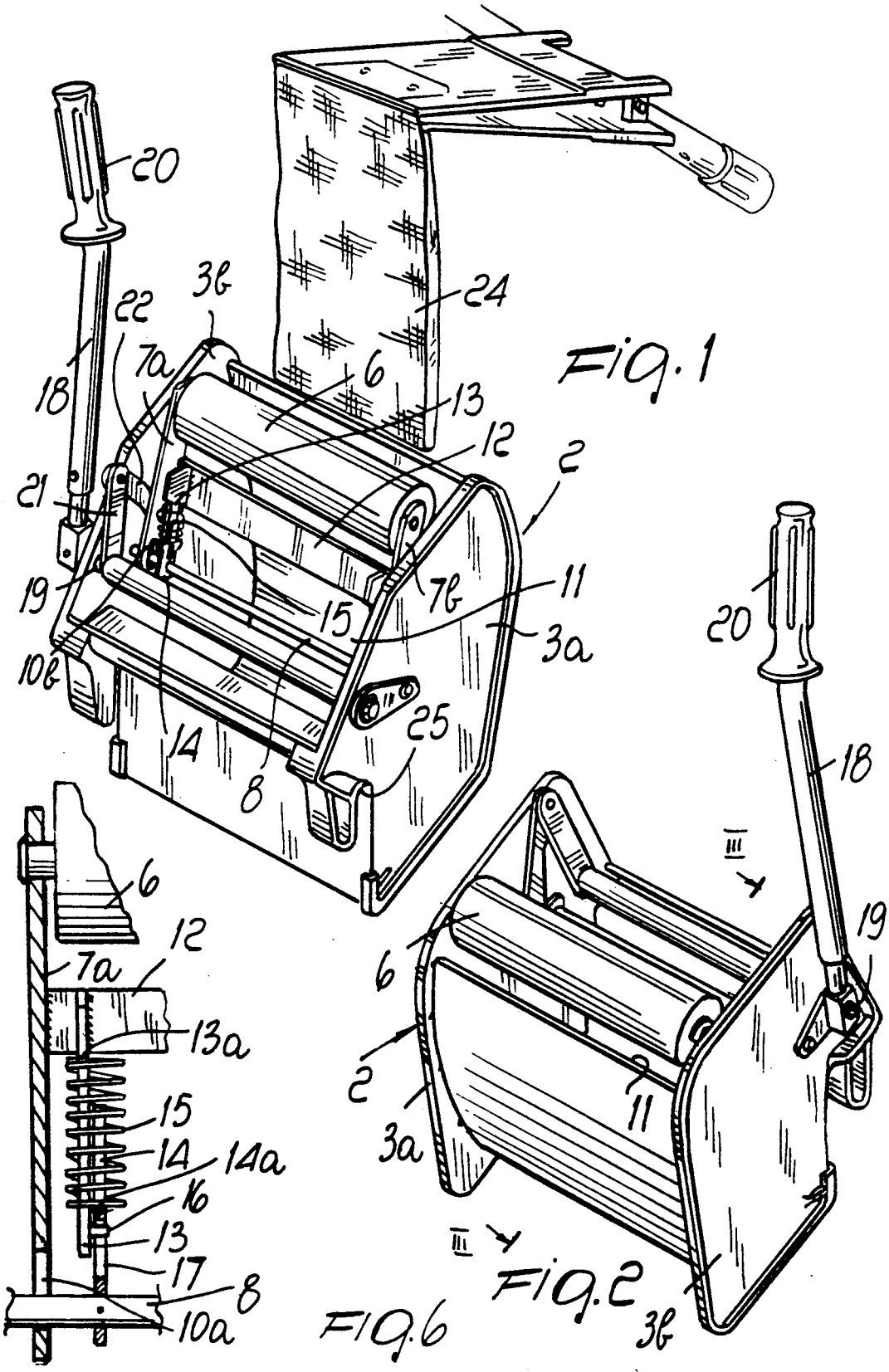
FIG. 1 is a front perspective view of the device according to the invention.
FIG. 2 is a rear perspective view of the device according to the invention.
FIG 6 is a schematic sectional view of FIG. 5, taken along the axis VI—VI.
Figure 3:
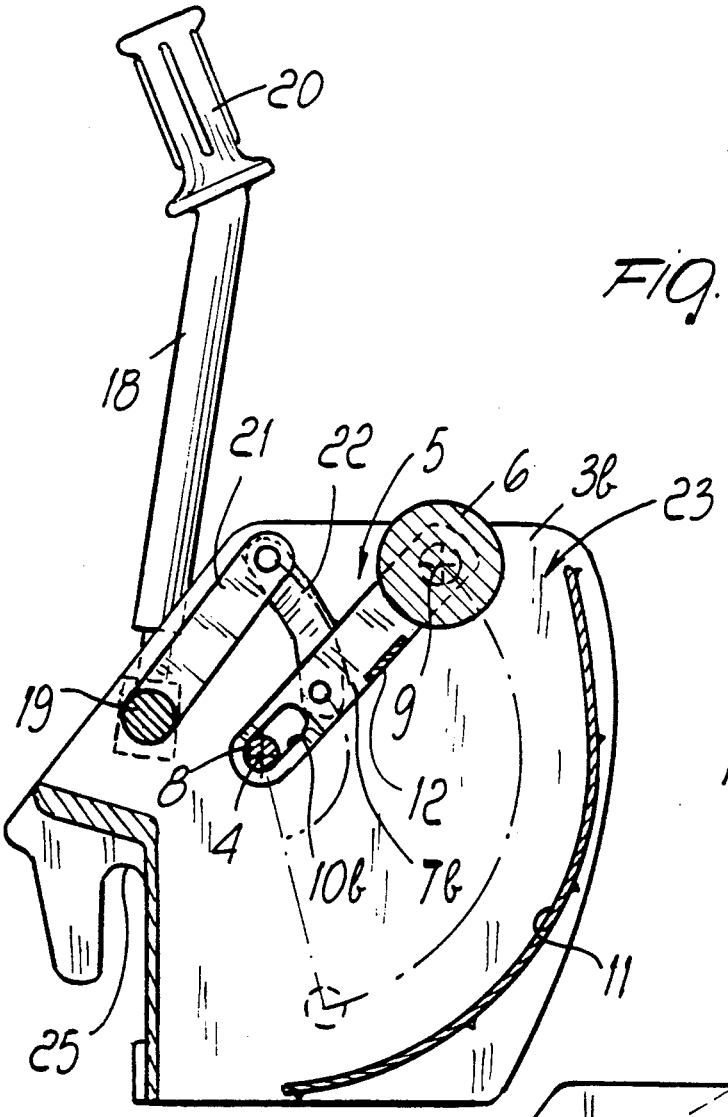
FIGS 3 and 4 are schematic sectional views of FIG. 2, taken along the axis III—III, illustrating the operation of the device.
Figure 5:
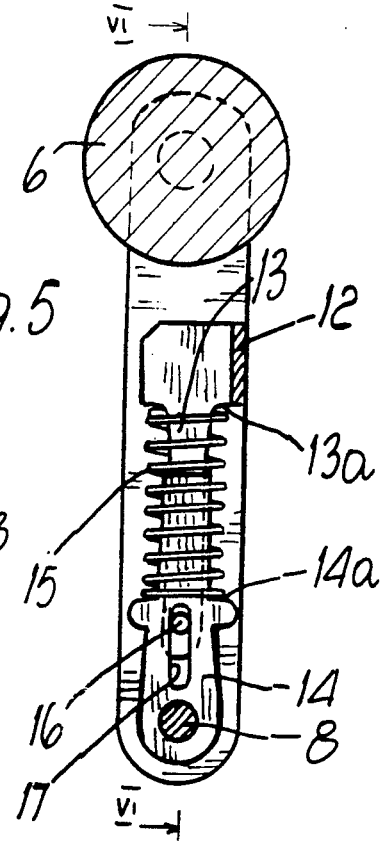
FIG 5 is an enlarged sectional detail view of the device.
Figure 4:
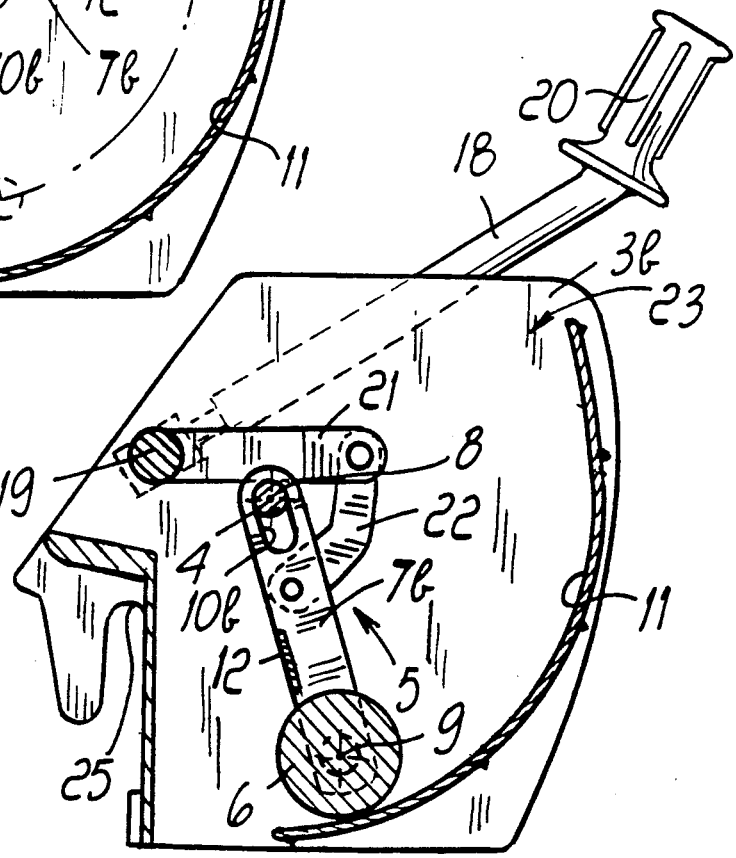

With reference to the above figures, the device according to the invention, comprises a frame 2 which is substantially constituted by a pair of vertical shoulders 3*a* and 3*b* which oscillatably support, about a main axis 4 which is horizontal and perpendicular to the shoulders 3*a* and 3*b*, a supporting element 5 on which a roller 6 is freely mounted.

More particularly, said supporting element 5 comprises a pair of arms 7*a* nd 7*b* which are mutually parallel and which extend transversely from a main shaft 8, the axis whereof coincides with the axis 4. Said arms 7*a* and 7*b* support, at one of their ends, the roller 6 so that it can rotate about its own axis 9, which is parallel to the main axis 4. The other ends of the arms 7*a* and 7*b* couple to the main shaft 8 by means of a pair of slots 10*a*and 10*b* which extend in the direction of the roller 6.

The frame 2 is provided with a wall or contrast wall 11 which joins the two shoulders 3*a* and 3*b* and which faces the roller 6. Said contrast wall 11 is shaped like a portion of a cylindrical surface having an axis which substantially coincides with the main axis 4.

Conveniently, the roller 6 can move toward or away from the contrast wall 11 by virtue of, or against the biasing action of, elastic means.

More particularly, the two arms 7*a* and 7*b* are mutually joined by an intermediate cross-member 12 which is parallel to the roller 6 and to the main shaft 8; two flat strips 13 extend from said cross-member 12 in the direction of the shaft 8 and slidingly couple, in a direction which is transverse to the axis 4, to two flat strips 14 which are associated with the main shaft 8. Shoulders 13*a* and 14*a* are defined on the flat strips 13 and 14, and a spring 15 winds around said flat strips and rests against said shoulders, elastically contrasting the approach of the roller 6 to the axis 4 which is allowed by the slots 10*a* and 10*b* or, more precisely, pushing the roller 6 against the contrast wall 11.

The sliding coupling between the flat strips 13 and 14 can be guided by the presence of the spring 15 alone, or it is possible to provide a pin 16 on the flat strips 13 which couples within a slot 17 of the flat strips 14 which is elongated parallel to the extension of the arms *7a* and *7b*.

Actuation means act on the supporting element 5 in order to achieve its oscillation about the main axis 4 and thus the sliding of the roller 6 along the contrast wall 11.

Said actuation means comprise an actuation lever 18 which is fixed, at one of its ends, to a secondary shaft 19 and has its other end provided with a handgrip 20. The secondary shaft 19 is arranged parallel to the main axis 4 and is rotatably supported, about its own axis, by the frame 2.

A crank 21 is fixed to the secondary shaft 19 and, by means of a connecting rod 22, is connected to one of the arms *7a* or *7b* so that an oscillation of the lever 18 causes oscillation of the roller 6 about the axis 4.

Conveniently, the useful length of the crank 21 is greater than the distance between the axis 4 and the pivoting point of the connecting rod 22 on the arm *7a* or *7b*, so that an arc of oscillation of the lever 18 corresponds to a greater oscillation arc for the roller 6. In this manner it is possible to contain the extent by which it is necessary to oscillate the lever 18, so that its actuation is extremely easy.

In the idle position, a slot 23 is defined between the roller 6 and the contrast wall 11 to allow the insertion of the strip 24 to be wrung.

Conveniently, the shoulders *3a* and *3b* have recesses 25 to allow the engagement of the device according to the invention to the edge of a tray for containing the liquid produced by wringing.

For the sake of completeness in description, it should be noted that the secondary shaft 19 is connected, by means of two cranks 21 and two connecting rods 22, to the arms *7a* and *7b* for a better distribution of the forces exchanged between the secondary shaft 19 and the arms *7a* and *7b*.

The operation of the device according to the invention is as follows.

With the roller 6 in idle position, i.e. raised, the strip 24 to be wrung is inserted, without removing it from the implement which bears it, between the roller 6 and the contrast wall 11.

The operator then acts on the actuation lever 18 so as to cause the oscillation of the roller 6 about the main axis 4 and thus make said roller slide along the strip 24, which is pressed against the contrast wall 11 by the roller 6 which rotates about its axis.

Once wringing is complete, the strip 24 is removed and the roller 6 is returned to the idle position by acting on the lever 18.

In practice it has been observed that the device according to the invention fully achieves the intended aim, since although it has an extremely simple structure which can be manufactured with modest costs, it performs an effective and rapid wringing of fringed strips for cleaning floors.

The device thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. Wringing device in particular for fringed strips for cleaning floors, comprising a frame which oscillatably supports, about a main axis, a supporting element for a roller which is freely mounted on said supporting element and which is arranged so that its axis is parallel to said main axis, said frame having a wall which faces said roller and being shaped like a portion of a cylindrical surface which has an axis which substantially coincides with said main axis, actuation means being furthermore provided which act on said supporting element for its oscillation about said main axis, with the consequent sliding of said roller along said wall to wring a fringed strip interposed between said roller and said wall, said supporting element comprising a pair of parallel arms which are mutually pivoted, at first ends thereof, to a main shaft having an axis which coincides with said main axis, and which support, at second ends thereof, said roller so that it is rotatable about its own axis with respect to said arms, said actuation means comprising an actuation lever which is fixed to a secondary shaft supported by said frame parallel to said main shaft, a crank being keyed on said secondary shaft, said crank being connected, by means of a connecting rod, to one if said arms, the useful length of said crank being greater than the distance between the pivoting point of said connecting rod on said arm and said main axis in order to multiply the angle of oscillation of said roller about said main axis with respect to the angle of oscillation of said crank induced by said actuation lever.

2. Device according to claim 1, wherein said roller is movable toward or away from said wall by virtue of the action of, or against the biasing action of elastic means.

3. Device according to claim 1, wherein said arms are coupled to said main shaft by means of a pair of slots elongated in the direction of said roller, elastic means being provided which are interposed between a portion rigidly associated with said main shaft and a portion rigidly associated with said arms in order to elastically contrast the movement of said roller away from said wall.

4. Device according to claim 1, wherein said frame is provided with means for coupling to a tray.

5. Device according to claim 1, wherein said main axis is arranged horizontally.

6. Device according to claim 1, wherein a slot for the insertion of a fringed strip is defined, in idle conditions, between said roller and said wall.

* * * * *